US008953932B2

(12) United States Patent
Hughes

(10) Patent No.: US 8,953,932 B2
(45) Date of Patent: Feb. 10, 2015

(54) TEMPERATURE CONTROL OF LIQUIDS, IN PARTICULAR CONTINUOUS FLOW HEATING

(75) Inventor: Michael Karl William Hughes, Flint Clwyd (GB)

(73) Assignee: Michael Karl William Hughes, Flint Clwyd (GB)

( * ) Notice: Subject to any disclaimer, the term of this patent is extended or adjusted under 35 U.S.C. 154(b) by 943 days.

(21) Appl. No.: 12/531,205

(22) PCT Filed: Mar. 14, 2008

(86) PCT No.: PCT/GB2008/050183

§ 371 (c)(1), (2), (4) Date: Apr. 21, 2010

(87) PCT Pub. No.: WO2008/110847

PCT Pub. Date: Sep. 18, 2008

(65) Prior Publication Data

US 2010/0193492 A1 Aug. 5, 2010

(30) Foreign Application Priority Data

Mar. 14, 2007 (GB) ..... 0704892.9

(51) Int. Cl.

| | |
|---|---|
| ***F24C 1/00*** | (2006.01) |
| ***F24H 1/10*** | (2006.01) |
| ***F24H 9/20*** | (2006.01) |

(52) U.S. Cl.

CPC ..... *F24H 1/103* (2013.01); *F24H 9/2028* (2013.01)

USPC ..... 392/308; 392/311; 392/314; 392/316; 392/341; 392/397; 392/480; 219/214; 219/236; 219/251; 219/448.19; 219/514; 219/624; 219/629; 219/689; 219/630

(58) Field of Classification Search

USPC ..... 219/214, 236, 251, 630; 392/488, 489

See application file for complete search history.

(56) References Cited

U.S. PATENT DOCUMENTS

| | | | | |
|---|---|---|---|---|
| 4,550,358 | A * | 10/1985 | Crowley et al. | 361/42 |
| 5,832,179 | A * | 11/1998 | Kim et al. | 392/489 |
| 6,196,162 | B1 * | 3/2001 | Sparrowhawk | 122/13.3 |
| 6,456,785 | B1 * | 9/2002 | Evans | 392/488 |

(Continued)

FOREIGN PATENT DOCUMENTS

| | | |
|---|---|---|
| EP | 1380243 A1 | 1/2004 |
| EP | 1400762 A1 | 3/2004 |
| FR | 994870 | 11/1951 |

(Continued)

OTHER PUBLICATIONS

LeClaire, Thomas, "PCT International Search Report and Written Opinion," Sep. 24, 2008, European Patent Office.

(Continued)

*Primary Examiner* — Steven Loke
*Assistant Examiner* — Cuong B Nguyen
(74) *Attorney, Agent, or Firm* — Hoffman Warnick LLC

(57) ABSTRACT

Disclosed is an apparatus for altering the temperature of a liquid, comprising: a pipe having a first end for receiving a liquid and a second end for discharging the liquid; and a thermal element for altering the temperature of the liquid, wherein the thermal element is located in the pipe such that the volume available for the liquid within the pipe is in the range 0 to 20% of the pipe volume.

17 Claims, 5 Drawing Sheets

(56) References Cited

U.S. PATENT DOCUMENTS

| | | | | |
|---|---|---|---|---|
| 8,104,434 | B2 * | 1/2012 | Fabrizio | 122/40 |
| 2004/0057709 | A1 * | 3/2004 | Leary et al. | 392/486 |

FOREIGN PATENT DOCUMENTS

| | | | |
|---|---|---|---|
| GB | 435160 | | 1/1935 |
| GB | 1454772 | | 11/1976 |
| GB | 2162027 | A | 1/1986 |
| GB | 2340590 | A | 2/2000 |

OTHER PUBLICATIONS

Blackmore, Ian, "UK Search Report," Jul. 18, 2007, UK Intellectual Property Office.

* cited by examiner

TEMPERATURE CONTROL OF LIQUIDS, IN PARTICULAR CONTINUOUS FLOW HEATING

This application is a national stage application under 35 U.S.C §371 of International Application No. PCT/GB2008/050183 having an international filing date of Mar. 14, 2008 which claims benefit under 35 USC §119 of GB 0704892.9 filed date of Mar. 14, 2007. The present invention relates to an apparatus and method for altering the temperature of a liquid. Embodiments of the invention find particular, but not exclusive, use in domestic or commercial situations, where relatively small quantities of water may be nearly instantaneously heated to or near boiling point for the preparation of hot beverages. Similarly, embodiments of the invention may be used to provide relatively small amounts of chilled water upon demand. Further embodiments may be used in a variety of industrial processes, where rapid heating or cooling of liquids is required.

Prior art water heaters for use in a domestic environment can take one or more forms. Typically, most homes will possess an electric kettle for boiling water for making hot beverages, such as tea and coffee. Usually, the user of the kettle pays little attention to the amount of water which is actually required and simply fills it to a level which is sure to suffice. This can result in the waste of a large amount of electrical energy, used to boil the unneeded water. A typical full kettle-load of water can take several minutes to boil.

Prior art document EP1400762A1 discloses a water heater for use in an aeroplane toilet compartment. It comprises a tube containing water, in which is situated a heating element. It is provided to warm relatively small amounts of water to a temperature suitable for hand-washing. The heating element may be positioned internal or external to the tube carrying the water.

With the ever-increasing need to conserve energy, people are now encouraged to boil only the quantity of water required for a particular task. However, this advice is seldom followed, resulting in vast amounts of energy being wasted every day. Furthermore, the time taken to produce a given amount of boiled water can be excessive, but this is generally accepted as the norm.

Embodiments of the present invention aim to address problems with the prior art, whether mentioned herein or not. In particular, embodiments of the present invention aim to reduce wasted energy in preparing heated water and to reduce the time taken to produce a given quantity of heated water.

According to the present invention there is provided an apparatus and method as set forth in the appended claims. Preferred features of the invention will be apparent from the dependent claims, and the description which follows.

Embodiments of the invention deliver a near-instantaneous supply of heated water for the purposes of making beverages such as tea or coffee. Preferably the water is heated to boiling point or just below.

Embodiments of the invention offer an easy-to-install energy efficient solution to the problem of providing a single-point water heater. Apparatus according to an embodiment of the invention is able to heat just the quantity of water which is required, with little or no energy wasted in heating water which is surplus to that requirement.

Embodiments of the invention may be simply retro-fitted to existing utilities or provided along with other services in new-build situations.

The means by which the advantageous effects of the invention are delivered relate to deliberately constraining the amount of liquid contained in the apparatus at any one time and ensuring that said volume of liquid is exposed to as much of the surface area of a thermal element as possible. In this way, very little energy is wasted in altering the temperature of liquid which is not to be discharged from the apparatus, unlike prior art kettles and other single-point heater systems where an appreciable amount of energy is routinely wasted.

Embodiments of the invention utilise the somewhat counter-intuitive approach of nearly completely filling the thermal vessel (e.g. pipe) with a thermal element, in such a way that there is a very small volume available for the element.

Preferably, the volume available for the liquid is less than 20% of the total available volume. The advantageous effects of the invention become more pronounced as this residual volume is decreased. There is no practical lower limit, provided that liquid can travel through the system.

Alternatively, embodiments may be configured to provide a near-instantaneous supply of chilled water by use of a suitable chilling device.

For a better understanding of the invention, and to show how embodiments of the same may be carried into effect, reference will now be made, by way of example, to the accompanying diagrammatic drawings in which.

Embodiments of the present invention provide a convenient, economic and energy-efficient means to alter the temperature of a liquid. In particular, but not exclusively, they provide a convenient means of providing a continuous stream of boiling (or near-boiling) water, e.g. for making hot beverages, without wasting energy by boiling water in a kettle which is then not used and is left to cool.

Embodiments of the invention make use of the realisation that a system arranged to receive a continuous flow of liquid and discharge it at a different temperature can yield benefits by deliberately constraining the volume of water retained within the system. Smaller volumes are able to be heated or cooled more quickly than large amounts (for a given rating of thermal element), and by restricting the volume retained within the system after it has completed discharging, the amount of energy wasted in heating or cooling liquid which is not needed for a particular application can be similarly reduced.

In the description which follows the liquid used as an example is water, but the skilled man will appreciate that other liquids could be used. Similarly, reference will be made to heating the liquid, but the skilled man will appreciate that embodiments of the invention can be arranged to cool a liquid instead.

Figure 1:
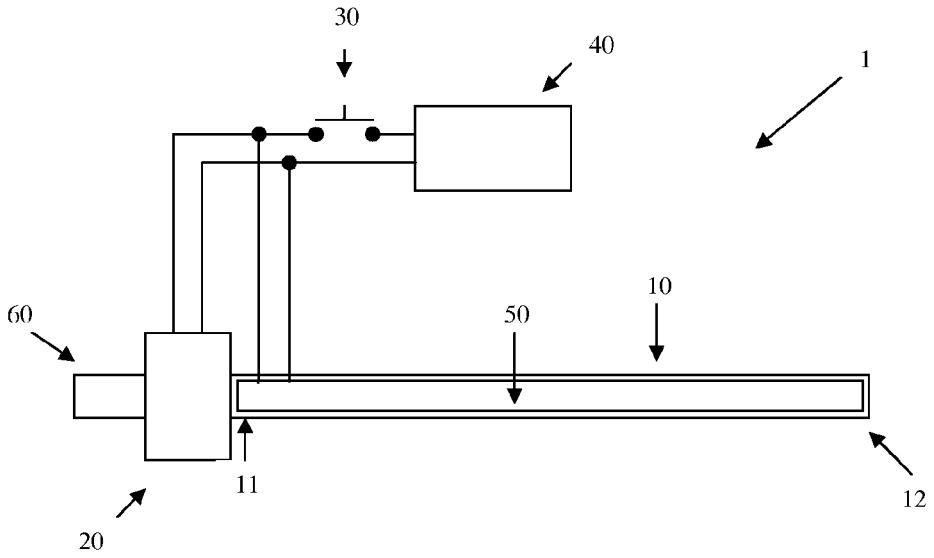
FIG. 1 shows a representative schematic of a first embodiment of the present invention.

FIG. 1 shows a schematic representation of an embodiment of the present invention. The apparatus 1 comprises a pipe 10, having a first end 11 for receiving a liquid, a length down which the liquid passes and a second end 12 for discharging the liquid.

Arranged at the first end 11 of the pipe 10 is a solenoid valve 20 which controls the flow of liquid into the pipe. The solenoid valve receives a constant water supply, e.g. a mains water connection 60, at its input, and its output feeds directly to the first end 11 of the pipe. The solenoid valve is electrically operated, and power is supplied to it to open the valve by operation of switch 30.

Switch 30 is a push-to-make switch which supplies electrical power to the solenoid valve 20 from a mains electrical supply 40 for as long as the switch 30 is depressed.

Operation of switch 30 also supplies electrical power from supply 40 to the heating element 50, which is located inside the pipe 10 as will be described shortly.

In use, when the switch 30 is depressed, the solenoid valve 20 opens allowing the inherent water pressure of the mains supply 60 to force water into pipe 10 via inlet 11. At the same time, the heating element 50 is energised and rapidly reaches its operating temperature. Approximately 1 second after operating the switch 30, the water leaving the spout is at the desired temperature (usually in the range 90-100° C.)

Water entering the pipe 10 via inlet 11 is therefore heated by the heating element 50 as it passes along the length of the pipe and is then discharged from the outlet 12. By the time the water reaches the outlet 12, it is at, or substantially at, boiling point (100° C.) or a temperature suitable for making a hot beverage.

In an embodiment for use in the UK, where the mains voltage supply is 240V (AC, 50 Hz), the maximum rated element which is operable from a standard 13 Amp ring main is approximately 3.1 KW. In other countries, having different mains voltage supplies, different ratings may be required, with other consequential alterations to the system. Note that in the USA, particularly, which has a lower voltage mains supply, three-phase power is typically provided to power electric cookers and laundry apparatus, and this supply may be used in place of the regular 110V mains supply.

As soon as the switch 30 is released, the power is disconnected from the solenoid valve 20 and heating element 50, and water ceases to be discharged from outlet 12.

The heating element 50 is dimensioned such that it substantially fills the internal void of pipe 10 in terms of both length and diameter. In practice, it has been found that a typical copper water pipe having an external diameter of 10.00 millimeters has a wall thickness of 0.70 millimeters, leaving an internal diameter of 8.60 millimeters. A heating element having an external diameter of 8.00 millimeters is fitted into the pipe. In practice it is found that a pipe and a heating element of the dimensions given allows the element to be inserted into the pipe by hand, using a moderate degree of manual force but without the need for special assembly equipment. An element of approximately 3 meters in length can be inserted in this fashion.

However, use of a hydraulic or other press may be required in some instances, particularly if the manufacturing tolerances are slightly imperfect. Additionally, or alternatively, the copper pipe may be heated to cause a certain amount of expansion, thereby easing insertion of the element.

Once the element 50 has been fitted into the pipe 10, there is a notional 0.30 millimeter clearance all the way around the element before the internal surface of the pipe is encountered. Although such a gap is tiny and barely visible to the human eye, it offers sufficient space for water to travel down the pipe, especially under mains pressure.

Such a configuration allows a relatively small amount of water to come into contact with a relatively large surface area of heating element, ensuring rapid heating of the water. This is in contrast to prior art kettles and single point water heaters where essentially the entire volume of water to be heated is present in the heating vessel before heating begins. In embodiments of the invention, there is a continuous flow of relatively cold water flowing into the system for contemporaneous heating of the water.

Figure 3:
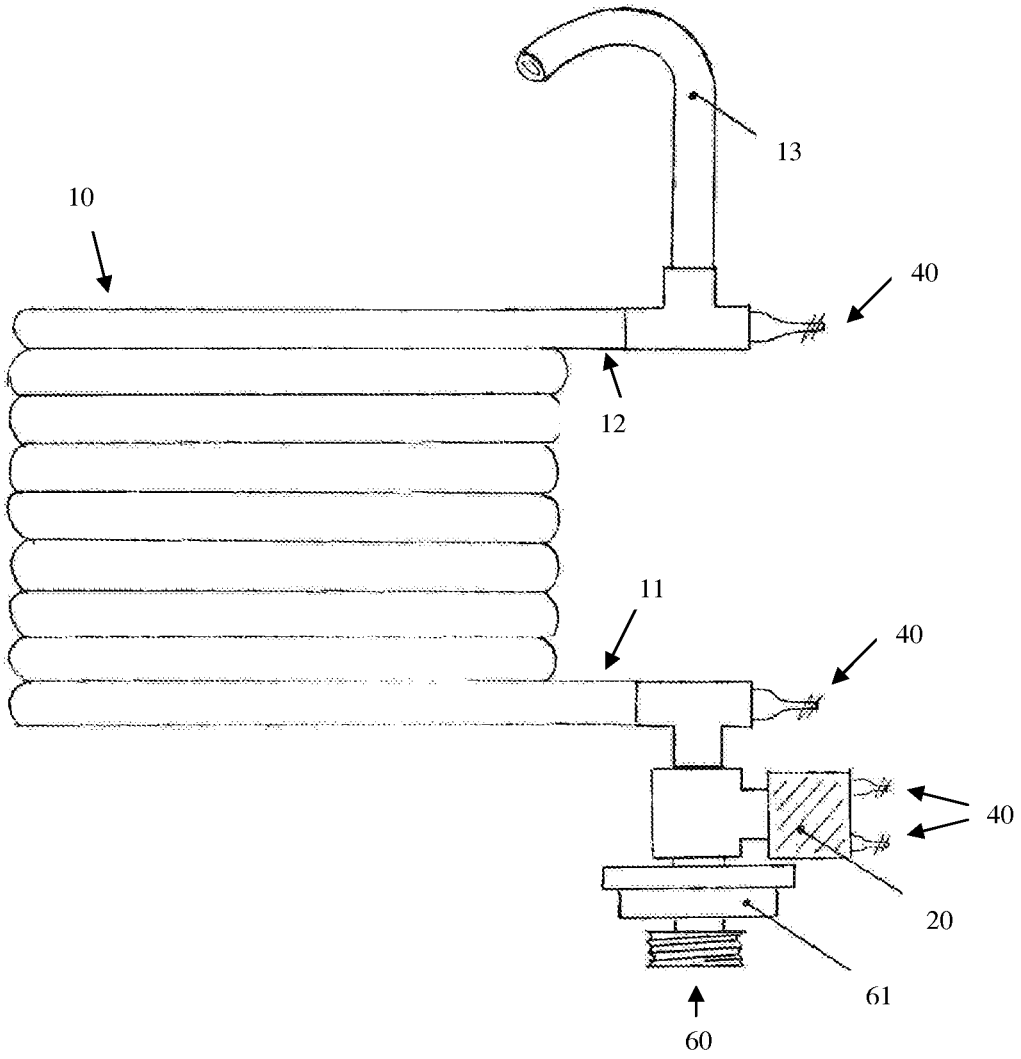
FIG. 3 shows a physical configuration of an embodiment of the present invention.
Figure 4:
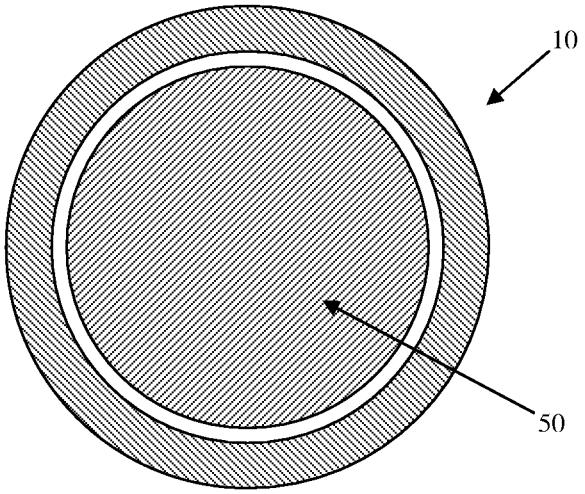
FIG. 4 shows a cross section through a pipe of an embodiment of the present invention.

A typical installation in a domestic environment comprises a length of pipe of approximately 3 meters. This may be coiled or otherwise shaped to minimise the space occupied by the apparatus. Such an arrangement is shown in FIG. 3. In the configuration shown in FIG. 3, the entire arrangement is able to fit easily in the space underneath most sinks or worktops.

The spout 13 at the outlet 12 of the pipe is arranged to project from a surface of a sink or worktop such that it discharges into said sink. The switch 30 is positioned integral to the spout, in the same manner as prior-art push-taps. Alternatively, the switch may be positioned remotely.

Embodiments of the invention may be incorporated into prior art taps and tap combinations. For instance, a kitchen mixer tap may be provided with 3 controls—one for cold water, one for hot water and a third for boiling water for preparing hot beverages.

The water supply to the unit can be pre-filtered to remove dissolved compounds. A further control may be provided to open the solenoid 20 only, and not the heater 30, so that cool filtered water only is dispensed.

A water supply 60 is attached to the solenoid valve 20, and electrical power 40 is supplied to the unit, to be selectively applied by use of switch 30. Pressure regulator 61 is provided to ensure that over-pressure situations do not occur. However, this component is optional and not required in all cases.

In an alternative embodiment, the pressure/flow regulator 61 can be replaced by an electronic control system, which works in conjunction with a temperature sensor (not shown) located near the spout 13. In this embodiment, when switch 30 is activated, the solenoid 20 initially stays shut, but the heating element 50 is immediately energised.

Once the temperature sensor determines that a preset temperature had been reached (e.g. 95° C.), the solenoid 20 is opened and the flow of heated water from spout 13 begins.

In order to regulate the temperature of the water from the spout, the temperature sensor can be set to register a predefined drop in output temperature (say 2° C.). If such a drop is registered, then the solenoid 20 is shut, momentarily stopping the flow. As soon as the temperature sensor registers the desired preset temperature again, then the solenoid is opened again. It has been found in practice that this technique of regulating the temperature of the output is effective and results in a substantially steady flow of heated water, with no discernible sputtering.

A variation of this arrangement includes a timer circuit which dispenses a preset amount of heated water at the touch of the switch 30.

Figure 2:
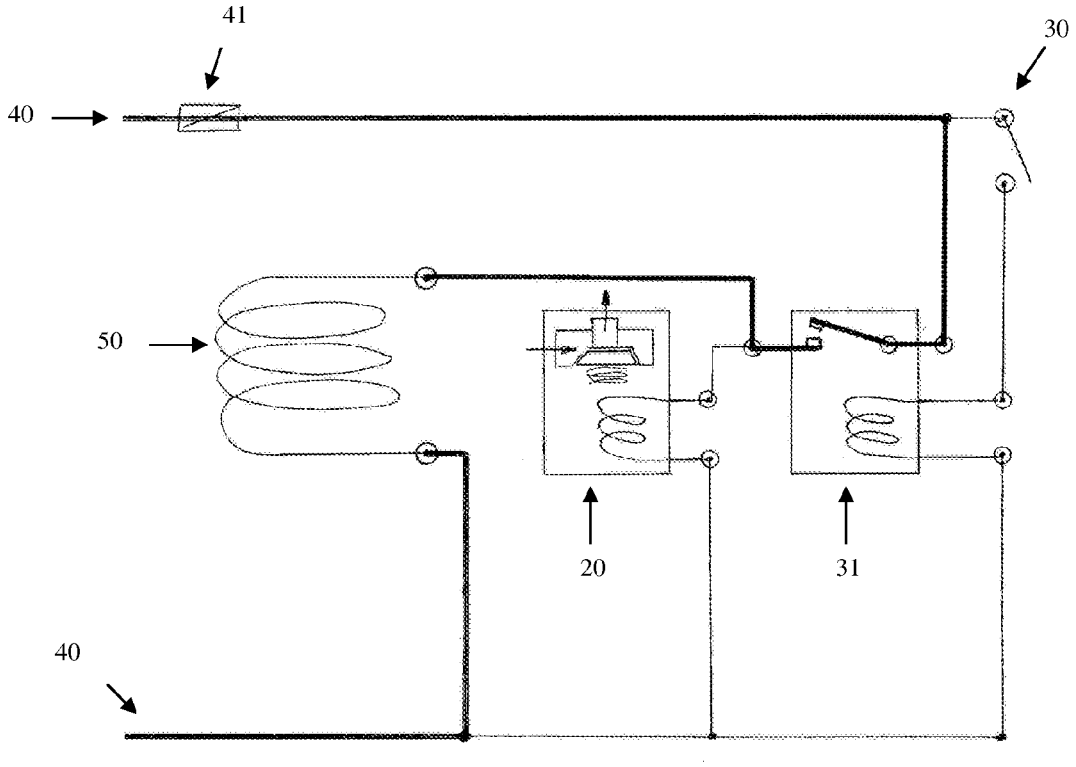
FIG. 2 shows an alternative embodiment of the present invention.

FIG. 2 shows a slightly different embodiment of the present invention. In this embodiment, actuation of the switch 30 energises a relay 31, which in turn supplies power to solenoid valve 20. The basic operation of this embodiment is essentially the same as that of the previously described embodiment, but provides a degree of isolation between the power supply 40 and the water supply.

In another alternative embodiment, the relay may be energised using a low voltage power supply, with other details as shown in FIG. 2. Such an arrangement may be of use where local regulations require greater isolation between mains voltages and water supplies.

A particular feature of embodiments of the present invention is that the residual volume of water retained in the system after operation is minimised as far as practically possible, meaning that the amount of energy wasted in heating said residual volume of water, which is not discharged, is also minimised as far as possible, and that the time between operating switch 30 and hot water being discharged is as short as possible.

The discovery that fitting an element sized to substantially fill the pipe such that a small amount of residual water could yield such a change in performance is somewhat counter-intuitive and it is only after extensive experimentation that a suitable compromise between manufacturing constraints, flow rate and thermal performance was determined.

At any one time, the volume of water in the pipe 10 is relatively small compared to the overall volume of the pipe. This is due to majority of the volume of the pipe being occupied by the heating element 50. This arrangement means that there is a very small residual volume of water in the device at any one time, and what water there is in the system is in contact with substantially all the surface area of the element, meaning that it is very quickly heated to boiling point.

In the present embodiment, the volume of the interior of pipe 10 is given by the following equation (in the form of length×cross-sectional area):

$$3\times\pi(4.30\times10^{-3})^2=174.26\text{ mL} \quad (1)$$

The volume occupied within the pipe 10 by element 50 is given by the following equation:

$$3\times\pi(4.00\times10^{-3})^2=150.80\text{ mL} \quad (2)$$

Therefore, the volume available for water=(1)−(2)=23.46 mL.

In a pipe of 3 m length, and having an external diameter of 10 mm, 23 mL (approximately 5 standard teaspoons) of water in contact with a heating element is a very small amount. The small volume of water is what enables the element to heat the water so rapidly to the desired temperature. The percentage of the overall volume of the pipe occupied by water is given by ((1)−(2))/(1)), which in this case is approximately 13.5%.

Empirically, it is found that a residual volume of this magnitude is the optimum compromise between the various, often conflicting, constraints at play. If the residual volume is made more than 20%, then it is found that the benefits of the invention do not manifest themselves so readily i.e. there is a significant delay between actuation of switch 30 and the appearance of hot water, and more energy is wasted in heating water which is retained within the apparatus when switch 30 is released The gap between the element and the interior of the pipe is stated to be 0.30 millimeters in the examples given thus far. In practice, the skilled man will appreciate that an even smaller gap could produce even better results, perhaps at the expense of a reduced flow rate. A smaller gap will consequently lead to a smaller residual volume.

The preferred embodiment of the present invention relies upon mains water pressure alone to force the water through the pipe 10 to be heated by the heating element 50 and to be discharged from the outlet of the system. However, in an alternative embodiment, which may be useful in areas with low mains water pressure, it is possible to supplement the force of the mains water pressure with a separate pump for forcing the cold water through the pipe 10 for heating. A further advantage of such a system is that an even smaller gap between the heating element and the interior of the pipe may be provided, which has the added advantage of further reducing the residual volume of water in the system.

If a pump is to be added, it can be positioned either before or after the solenoid 20 and it can be powered by the same operation of switch 30 that is used to power the heater and the solenoid.

The 0.30 millimeter gap, in a 10 mm pipe, which has been illustrated here has been selected as a compromise between ease of manufacture (i.e. actually inserting the element into the pipe) and achieving a useful flow rate and rate of temperature change.

In practice, it is found that there is no effective lower limit on the gap size, aside from manufacturing considerations. For a pipe having a nominal 10 mm external diameter (an internal diameter of 8.6 mm), then a 0.30 mm gap is found to offer the best compromise of manufacturability and performance. As the gap increases, the apparatus is easier to manufacture, but the increased residual water volume results in a diminished performance.

The above description refers to a pipe having a nominal 10 mm external diameter, which is in the normal range for domestic installations. For smaller pipe sizes, the gap between the element and the interior wall of the pipe should preferably be reduced still further so that the a similar relative volume of residual water is achieved. For larger pipe sizes, the gap can generally be maintained as-is or even increased.

To illustrate the differing effects of small and large diameter pipes, it is instructive to examine two relatively extreme examples. For a very small diameter pipe (e.g. internal diameter=3 mm), if a suitable element could be found (external diameter=2.4 mm) that could maintain the 0.30 mm nominal gap, then the residual volume of water would amount to 36% of the overall internal pipe volume and so the desirable effects of the invention would not be achieved in this case by simply preserving the same gap size. In such cases, it is necessary to decrease the gap so that a residual volume of less than 20% is achieved.

For a very large diameter pipe (e.g.>50 cm), which may be seen in industrial processes, the overall volume of the pipe is such that the volume of water retained in the gap (0.30 mm) between the element and the internal pipe wall is insignificant compared to the overall volume of the pipe. In such cases, the gap size can be increased, provided that the residual volume of water is maintained at less than 20%. Increasing the gap size in such cases assists in ease of manufacture and allows a greater throughflow of liquid for a given input pressure.

The 10 mm example used has been selected as an illustrative example of a typical domestic or light industrial use of embodiments of the invention. Pipe of this diameter is readily available, as are suitable heating elements. It is, though, clear that the same principle can be scaled and applied to pipes of any chosen diameter.

When a unit is retro-fitted to an existing electrical circuit (in the UK at least), the limiting factor is the 13 A fuse in the plug. In order to increase the power of the heater, it is possible to fit two supply cables, each with a 13 A fused plug, to the unit so that its effective supply current is 26 A. This enables a much more powerful heater to be used, with consequent improvements in performance and throughput.

In other situations, it may be possible to directly wire the unit to the electrical ring main, via an isolating switch, which may typically be fitted with a 20 A fuse. Again, better performance may be experienced in this way.

Figure 5:
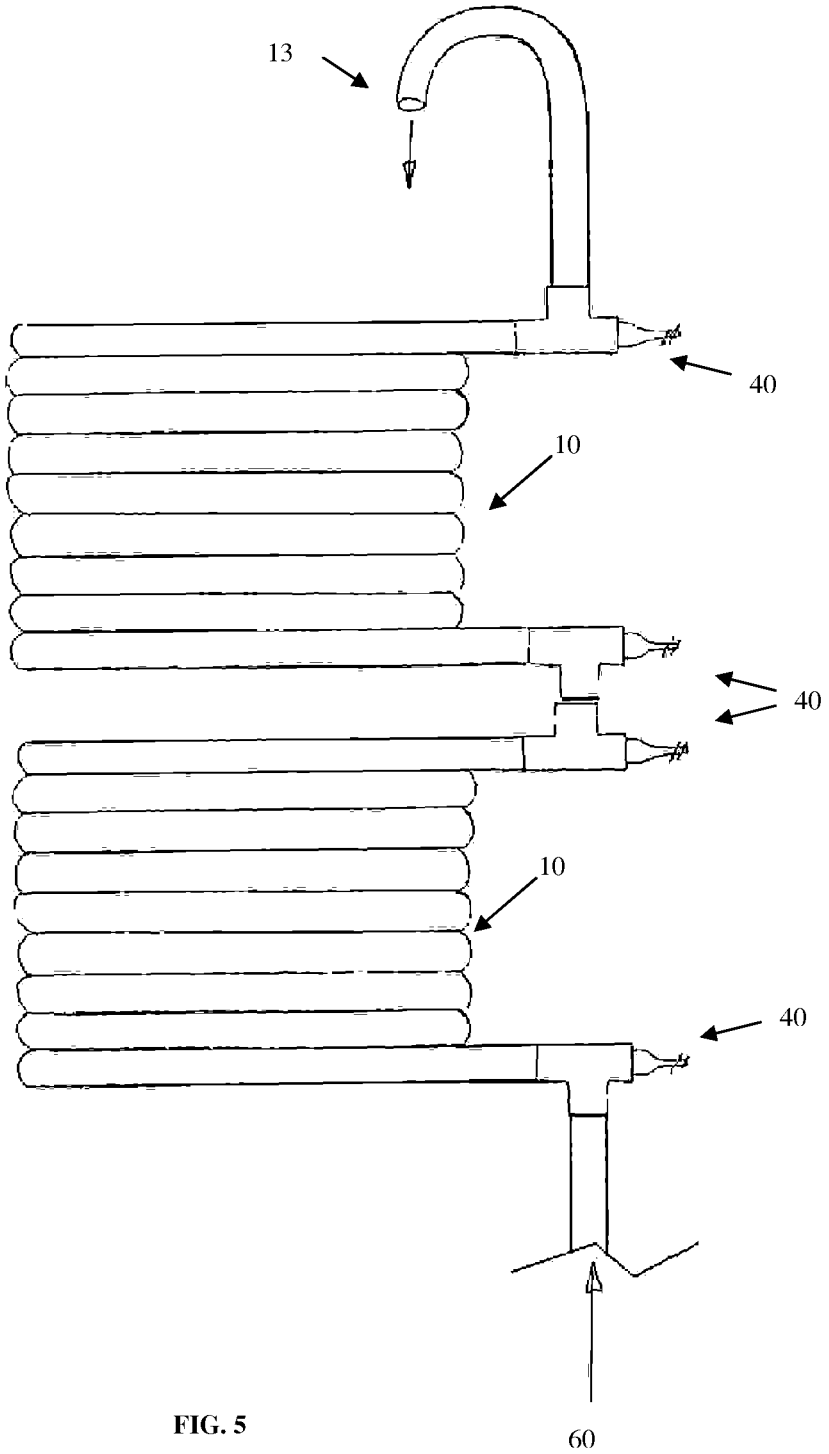
FIG. 5 shows an embodiment of the invention whereby two separate systems are installed in series.
Figure 6:
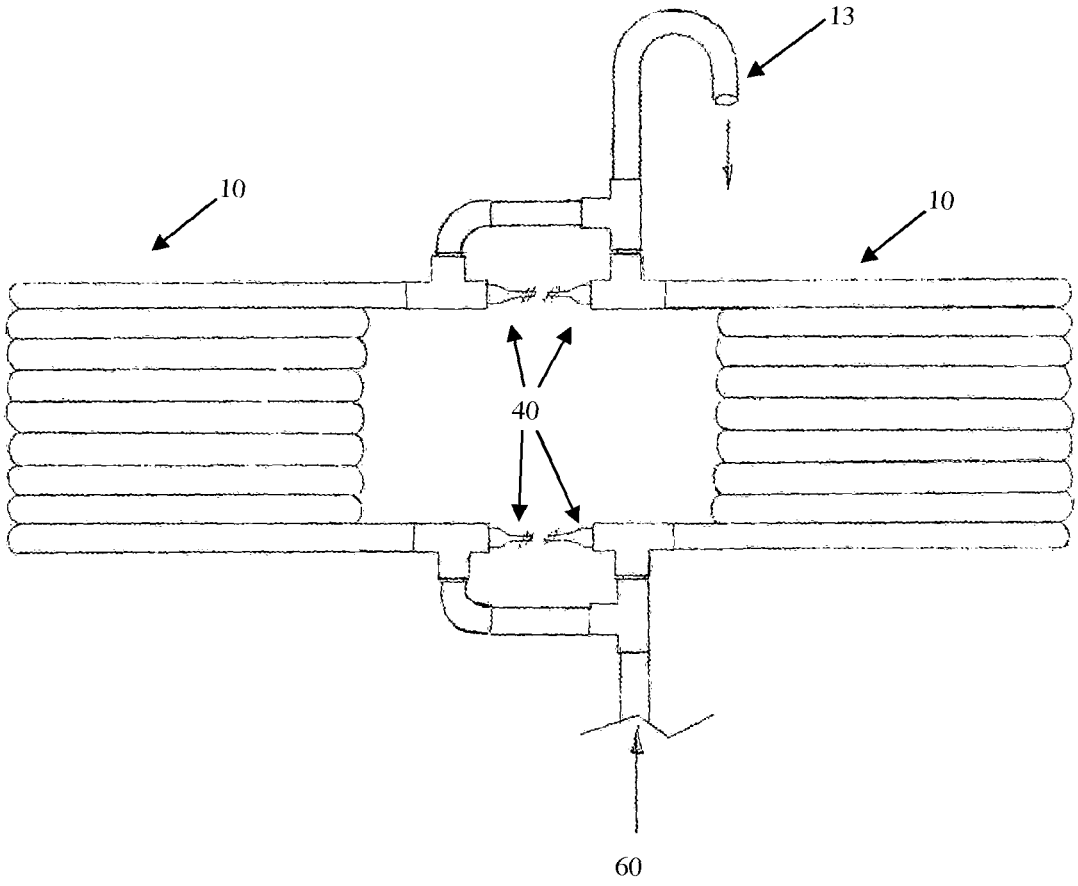
FIG. 6 shows an embodiment of the invention whereby two separate systems are installed in parallel.

In situations where an embodiment of the invention is fitted afresh and access to the electrical distribution board is possible, then it may be desirable to connect the heater into a suitably high-rated circuit (e.g. 30 Amps). This ensures maximum power and hence, maximum throughput. However, in situations where a heater is required and it is not convenient to connect it to the electrical distribution board, and only retro-fitting to an existing supply is possible, then it may be desirable to fit more than one heater and connect them either in series (see FIG. 5) or parallel (see FIG. 6).

In this way, two separate heaters, each fitted with a standard 13 Amp plug could be connected safely to operate in tandem and to provide increased performance. Of course, when two or more heaters are provided in series or parallel, as described above, it may also be possible to provide the arrangement with two or more 13 A power leads as described previously, provided that the electrical supply is adequate and this can be done within safe limits.

The embodiments described thus far have used an electrical heating element to raise the temperature of an incoming water supply. It should be noted that a cooling element, operating using normal refrigeration techniques or the Peltier effect may be used to produce a supply of chilled liquid on demand.

Furthermore, although the embodiments described above refer to raising the temperature of the incoming water for the purposes of preparing hot beverages, it is clear that a lower rated heater could be used to raise the temperature to a level suitable for hand washing, or indeed any other suitable temperature. Such an arrangement is particularly useful in e.g. public toilets/bathrooms, where the provision of a dedicated water heater of the prior art type is not always possible.

Similarly, although reference has been made to altering the temperature of an incoming supply of water, any other liquid could be used, enabling embodiments of the invention to be used in a wide variety of industrial applications.

Embodiments of the invention have been described with reference to a pipe, having a regular cross-section and length. The skilled person will appreciate that non-regular pipes, conduits, cylinders, tubes or other containers can be used with equivalent results.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An apparatus for altering the temperature of a liquid, comprising:

a pipe having a first end for receiving a liquid and a spout at a second end for discharging the liquid; and an elongate thermal element for altering the temperature of the liquid, wherein the elongate thermal element is uncoiled within the pipe such that a volume available for the liquid within the pipe is less than about 20% of the pipe volume.

2. The apparatus of claim 1 wherein the volume available for the liquid is about 3 to about 18% of the pipe volume.

3. The apparatus of claim 2 wherein the volume available for the liquid is about 6 to about 16% of the pipe volume.

4. The apparatus of claim 3 wherein the volume available for the liquid is about 14% of the pipe volume.

5. The apparatus of claim 1, further comprising an electrical switch, operation of which actuates a solenoid valve which allows the liquid to enter the first end of the pipe, and which is also operable to supply power to the elongate thermal element.

6. The apparatus of claim 1 wherein the elongate thermal element extends for substantially an entire length of the pipe.

7. The apparatus of claim 1 wherein the elongate thermal element is one of a heating element or a cooling element.

8. The apparatus of claim 1 wherein the pipe is coiled.

9. The apparatus of claim 1 wherein the pipe has an external diameter of about 10.00 mm and a wall thickness of about 0.70 mm.

10. The apparatus of claim 9 wherein the elongate thermal element has a diameter of about 8.00 mm.

11. The apparatus of claim 1 further comprising a pump to force the liquid into the pipe.

12. The apparatus of claim 1 wherein the apparatus comprises two power connections, each separately protected by a fuse.

13. An assembly comprising at least two of the apparatus of claim 1 connected either in series or in parallel.

14. The apparatus of claim 1, wherein the volume available for the liquid is defined by an equation $$V=((L_1\times\pi r_1^2)-(L_2\times\pi r_2^2)),$$

wherein $L_1$ is a length of the pipe, $r_1$ is an internal radius of the pipe, $L_2$ is a length of the thermal element, and $r_2$ is an external radius of the thermal element.

15. The apparatus of claim 1, wherein the thermal element has a cross-sectional shape substantially the same as a cross-sectional shape of the pipe.

16. A method of altering the temperature of a liquid, comprising steps of:

providing a conduit for liquid, the conduit comprising an inlet and an outlet;

providing a thermal element within the conduit, such that the thermal element occupies at least about 80% of an available volume within the conduit;

admitting the liquid into the inlet;

applying power to the thermal element; and discharging the liquid from the outlet.

17. The method of claim 16, wherein the available volume within the conduit is defined by an equation $$V=((L_1\times\pi r_1^2)-(L_2\times\pi r_2^2)),$$

wherein $L_1$ is a length of the conduit, $r_1$ is an internal radius of the conduit, $L_2$ is a length of the thermal element, and $r_2$ is an external radius of the thermal element.

* * * * *